US008923744B2

(12) United States Patent
Shimizu et al.

(10) Patent No.: US 8,923,744 B2
(45) Date of Patent: Dec. 30, 2014

(54) CLEANING DEVICE AND IMAGE FORMING APPARATUS

(71) Applicant: KYOCERA Document Solutions Inc., Osaka-shi, Osaka (JP)

(72) Inventors: Yoshimi Shimizu, Osaka (JP); Takahiko Murata, Osaka (JP); Ai Takagami, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 92 days.

(21) Appl. No.: 13/743,888

(22) Filed: Jan. 17, 2013

(65) Prior Publication Data

US 2013/0189009 A1 Jul. 25, 2013

(30) Foreign Application Priority Data

Jan. 19, 2012 (JP) ..... 2012-009432

(51) Int. Cl.
*G03G 21/00* (2006.01)

(52) U.S. Cl.
CPC ..... *G03G 21/0058* (2013.01); *G03G 21/007* (2013.01); *G03G 21/0029* (2013.01); *G03G 21/0076* (2013.01)
USPC ..... 399/349; 399/123; 399/350; 399/351; 399/353; 399/357

(58) Field of Classification Search
CPC ..... G03G 21/0029; G03G 21/007
USPC ..... 399/123, 350, 351, 353, 357, 349
See application file for complete search history.

(56) References Cited

U.S. PATENT DOCUMENTS 6,175,701 B1 * 1/2001 Kwon ..... 399/350
2006/0204297 A1 9/2006 Honda et al.

FOREIGN PATENT DOCUMENTS

JP 2006-251132 A 9/2006
JP 2008-176307 A 7/2008

OTHER PUBLICATIONS

Notice of Reasons for Rejection issued to JP Application No. 2012-009432, Jul. 2, 2013.

* cited by examiner

*Primary Examiner* — Ryan Walsh
(74) *Attorney, Agent, or Firm* — Arent Fox LLP

(57) ABSTRACT

A cleaning device includes: a cleaning rotating body 160; a scraping member 130; a toner restriction face 141; and a downstream side restriction portion 140. The cleaning rotating body 160 is arranged in sliding contact with the surface of the image carrying body 2. A front end portion 131 of the scraping member 130 is arranged in contact with or in proximity to a surface of the cleaning rotating body 160. The scraping member 130 is a plate-like member and includes a toner receiving face 133 to which the toner is carried from the front end portion 131. The toner restriction face 141 is arranged to be orthogonal to the toner receiving face 133. The downstream side restriction portion 140 restricts movement of the toner to a downstream side in a rotational direction of the cleaning rotating body 166.

12 Claims, 7 Drawing Sheets

CLEANING DEVICE AND IMAGE FORMING APPARATUS

INCORPORATION BY REFERENCE

This application is based on and claims the benefit of priority from Japanese Patent Application No. 2012-009432, filed on 19 Jan. 2012, the content of which is incorporated herein by reference.

BACKGROUND

The present disclosure relates to a cleaning device and an image forming apparatus provided with the same.

As a cleaning device for an image forming apparatus such as a printer, a cleaning device provided with a cleaning roller (cleaning rotating body) has been known. The cleaning roller of the cleaning device is arranged in sliding contact with a surface of a photoconductor drum (image carrying body) in a state of carrying a toner on a surface of the cleaning roller, thereby forming a toner layer.

In such a cleaning device, the cleaning roller is in sliding contact with a surface of a photoconductor drum and polishes the surface of the photoconductor drum. In addition, in such a cleaning device, it is necessary to maintain the amount of a toner on the surface of the cleaning roller uniform in a direction of a rotational shaft, in order to reduce uneven polishing of the surface of the photoconductor drum by the cleaning roller.

Here, if the amount of the toner on the surface of the cleaning roller is too large, the toner would be electrically charged due to friction with the photoconductor drum. The electrical charge of the toner leads to damage of the surface of the photoconductor drum. This may cause drum black spots (pinholes) on a resulting image; and so-called toner fall-off, where the toner falls onto a development region.

On the other hand, if the amount of the toner on the surface of the cleaning roller is too small, an abrasive force for polishing the surface of the photoconductor drum may be insufficient.

Meanwhile, a cleaning device further including, in addition to the above-described configuration, a scraper (scraping member) that is arranged such that a front end thereof is in contact with or in proximity to the surface of the cleaning roller has been known. In this cleaning device, the scraper scrapes off the toner adhering to the surface of the cleaning roller to thereby form a thin toner layer on the surface of the cleaning roller.

In the above-described cleaning device, on the surface of the cleaning roller, there may be portions with the toner attached and portions without the toner depending on a printing ratio and a printing pattern. As a result, the amount of the toner on the surface of the cleaning roller is not uniform in the direction of the rotational shaft. This may cause uneven polishing in the direction of the rotational shaft of the cleaning roller, leading to an image defect.

SUMMARY

The present disclosure is a cleaning device that cleans a surface of an image carrying body that is rotatable about a first rotational shaft. The present disclosure is a cleaning device including: a cleaning rotating body; a scraping member; a toner restriction face; and a downstream side restriction portion. The cleaning rotating body is rotatable about a second rotational shaft that is parallel to the first rotational shaft. The cleaning rotating body is arranged in sliding contact with the surface of the image carrying body in a state of carrying a toner on the surface thereof, thereby forming a toner layer. The scraping member is formed to extend in a direction of the second rotational shaft. A front end portion of the scraping member is arranged in contact with or in proximity to a surface of the cleaning rotating body. The scraping member is a plate-like member for scraping off a toner adhering to the surface of the cleaning rotating body. The scraping member is formed to extend such that a rear end portion, which is opposite to the front end portion, is arranged more on a downstream side in a rotational direction of the cleaning rotating body than a face connecting the second rotational shaft of the cleaning rotating body with the front end portion. The scraping member includes a toner receiving face. To the toner receiving face, the toner that has been scraped off by the scraping member is carried from the front end portion. The toner restriction face is arranged to be orthogonal to the toner receiving face, or arranged to be inclined with respect to a face orthogonal to the toner receiving face, when viewed from the second rotational shaft. The downstream side restriction portion restricts movement of the toner, which is to be carried from the front end portion to the toner receiving face, to a downstream side in a rotational direction of the cleaning rotating body.

The present disclosure is also an image forming apparatus including: at least one image carrying body on a surface of which an electrostatic latent image is formed; and the cleaning device.

DETAILED DESCRIPTION

Embodiments of the present disclosure are described hereinafter with reference to the drawings.

First Embodiment

Figure 1:
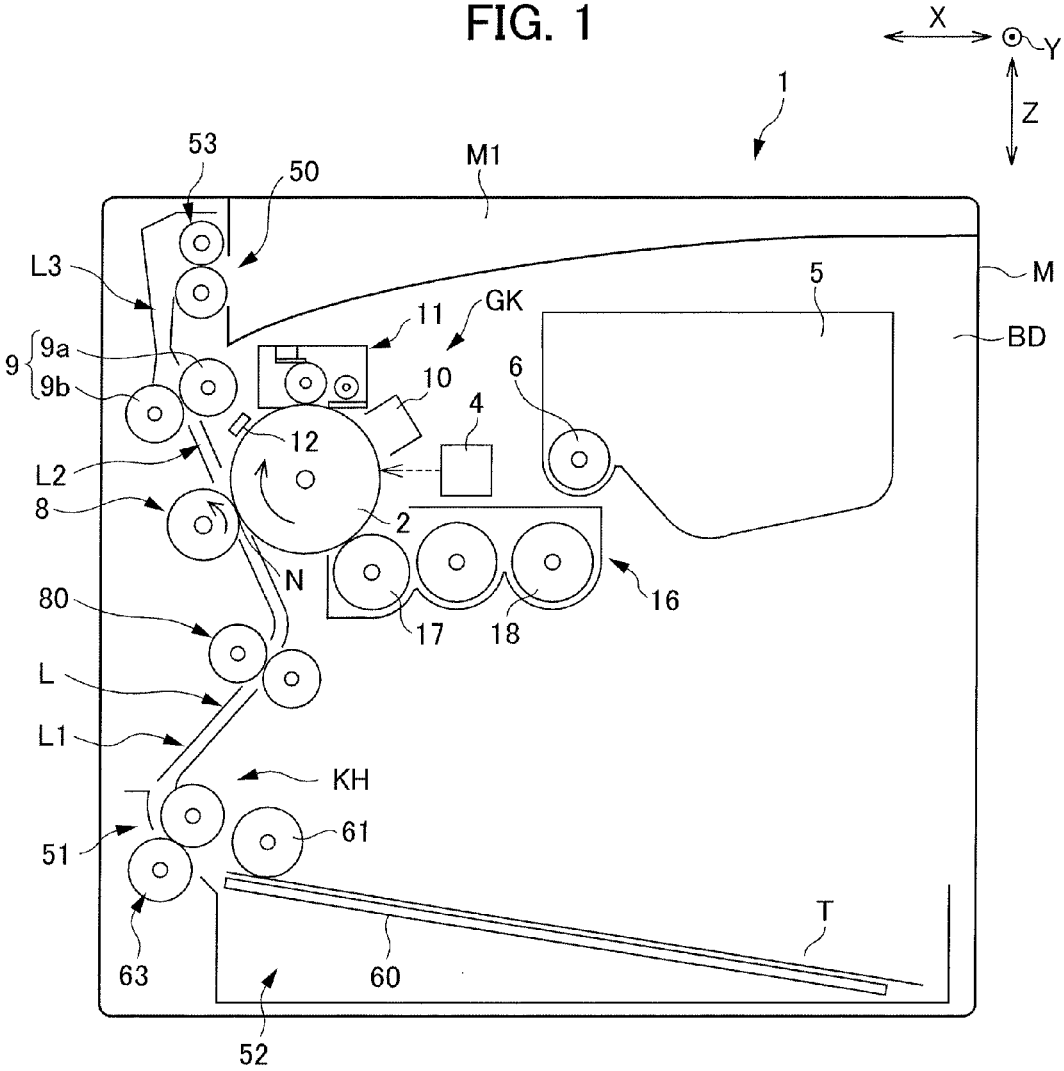
FIG. 1 is a diagram illustrating arrangement of components of a printer 1 according to a first embodiment of the present disclosure.

The overall structure of the printer 1 will be described as an example of the image forming apparatus according to the first embodiment, with reference to FIG. 1. FIG. 1 is a diagram illustrating arrangement of components of a printer 1 according to a first embodiment of the present disclosure.

Hereinafter, when viewed by a user standing in front of the printer 1, a horizontal direction is a direction of the arrow X, an anteroposterior direction (depth direction) is a direction of an arrow Y (see FIG. 4), and a vertical direction is a direction of an arrow Z.

As shown in FIG. 1, the printer 1 as the image forming apparatus includes an apparatus main body M, an image forming portion GK, and a paper feeding/discharge unit KH. The image-forming unit GK forms a predetermined toner image on paper T as a sheet-like transfer material, based on predetermined image information. The paper feeding/discharge portion KH feeds the paper T to the image-forming unit GK, and ejects the paper T with a toner image formed thereon.

An external shape of the device main body M is composed of a casing body BD as a housing.

As shown in FIG. 1, the image-forming unit GK includes a photoconductor drum 2 as an image carrier (photosensitive body), a charging unit 10, a laser scanner unit 4 as an exposure unit, a developing unit 16, a toner cartridge 5, a toner supply unit 6, a cleaning device 11, a neutralization unit 12, a transfer roller 8, and a fuser unit 9.

As shown in FIG. 1, the paper feeding/discharge portion KH includes a paper feed cassette 52, a conveyance path L for the paper T, a registration roller pair 80, and a paper ejection unit 50.

Configurations of the image-forming unit GK and the paper feeding/discharge portion KH are hereinafter described in detail.

First, the image-forming unit GK is described.

Charging by the charging unit 10, exposure by the laser scanner unit 4, development by the developing unit 16, transfer by the transfer roller 8, neutralization by the neutralization unit 12, and cleaning by the cleaning device 11 are sequentially performed in order, from an upstream side to a downstream side along a surface of the photoconductor drum 2 in the image-forming unit GK.

The photoconductor drum 2 is configured with a cylindrical member, and functions as a photosensitive body or an image carrier. The photoconductor drum 2 is arranged to be rotatable about a first rotational shaft J1 (see FIG. 2), in a direction of the arrow. The first rotational shaft J1 extends in a direction orthogonal to a direction in which the paper T is conveyed through the conveyance path L. An electrostatic latent image may be formed on the surface of the photoconductor drum 2.

The charging unit 10 is disposed to face the surface of the photoconductor drum 2. The charging unit 10 negatively or positively charges the surface of the photoconductor drum 2 uniformly (with negative or positive polarity).

The laser scanner unit 4 functions as an exposure unit, and is disposed to be spaced apart from the surface of the photoconductor drum 2. The laser scanner unit 4 is configured with a laser light source, a polygon mirror, a polygon-mirror-driving motor and the like, none of which are illustrated in the drawings.

The laser scanner unit 4 scans and exposes the surface of the photoconductor drum 2 based on image information that is input from an external device such as a PC (personal computer). By being scanned and exposed by the laser scanner unit 4, an electric charge in the exposed portion on the surface of the photoconductor drum 2 is removed. In this way, an electrostatic latent image is formed on the surface of the photoconductor drum 2.

The developing unit 16 is provided in correspondence with the photoconductor drum 2, and is disposed to face the surface of the photoconductor drum 2. The developing unit 16 causes single color toner (black toner in general) to adhere to an electrostatic latent image formed on the photoconductor drum 2, thereby forming a single color toner image on the surface of the photoconductor drum 2. The developing unit 16 is configured with a developing roller 17 disposed to face the surface of the photoconductor drum 2, an agitation roller 18 for agitating toner, and the like.

The toner cartridge 5 is provided in correspondence with the developing unit 16, and stores toner to be supplied to the developing unit 16.

The toner supply unit 6 is provided in correspondence with the toner cartridge 5 and the developing unit 16, and supplies toner stored in the toner cartridge 5 to the developing unit 16. The toner supply unit 6 and the developing unit 16 are connected with each other via a toner feed passage that is not illustrated in the drawings.

The transfer roller 8 transfers a toner image, which has been developed on the surface of the photoconductor drum 2, onto the paper T. A transfer bias application unit (not shown) applies a transfer bias to the transfer roller 8 for transferring a toner image formed on the photoconductor drum 2 onto the paper T. The transfer roller 8 is configured to be rotatable in a state of abutting the photoconductor drum 2.

The paper T conveyed through the conveyance path L is interposed between the photoconductor drum 2 and the transfer roller 8. The interposed paper T is pressed against the surface of the photoconductor drum 2. A transfer nip N is formed between the photoconductor drum 2 and the transfer roller 8. In the transfer nip N, a toner image developed on the photoconductor drum 2 is transferred onto the paper T.

The neutralization unit 12 is disposed to face the surface of the photoconductor drum 2. By radiating light on the surface of the photoconductor drum 2, the neutralization unit 12 discharges electricity (neutralizes electrical charge) on the surface of the photoconductor drum 2, onto which the transfer has been performed.

The cleaning device 11 is disposed to face the surface of the photoconductor drum 2. The cleaning device 11 removes toner and attached matters on the surface of the photoconductor drum 2. The cleaning device 11 conveys the toner and the like thus removed to a predetermined collection mechanism for collection.

The cleaning device 11 will later be described in detail.

By melting and pressurizing the toner that forms a toner image transferred onto the paper T, the fuser unit 9 fixes the toner on the paper T. The fuser unit 9 includes a heating rotator 9*a* that is heated by a heater, and a pressing rotator 9*b* that is brought into pressure-contact with the heat rotator 9*a*. The heating rotor 9*a* and the pressing rotator 9*b* interpose, press and convey the paper T with the toner image transferred thereon. The paper T is conveyed in a state of being sandwiched between the heating rotator 9*a* and the pressing rotator 9*b*, thereby fusing, pressurizing and fixing the toner transferred thereto.

Next, the paper feeding/discharge portion KH is described.

As shown in FIG. 1, a paper cassette 52 for storing paper T is disposed in a lower portion of the apparatus main unit M. The paper feeding cassette 52 is configured to be horizontally withdrawable from a left side (left side in FIG. 1) of the apparatus main body M. The paper feeding cassette 52 includes a paper tray 60. The paper T is placed on the paper tray 60. The paper feeding cassette 52 stores the paper T. The paper T is stacked on the paper tray 60. The paper T thus stacked on the paper tray 60 is fed by the cassette feeding unit 51 to the conveyance path L. The cassette feeding unit 51 is disposed in an end portion of the paper feeding cassette 52 on a side of feeding the paper (in a left end portion of FIG. 1). The cassette feeding unit 51 is provided with a double feed prevention mechanism consisting of a forward feeding roller 61 and a paper feeding roller pair 63. The forward feeding roller 61 is provided for picking up the paper T on the paper tray 60. The paper feeding roller pair 63 is provided for feeding the paper T sheet by sheet to the conveyance path L.

A paper ejection unit 50 is provided to an upper side of the apparatus main unit M. The paper ejection unit 50 ejects the paper T to the outside of the apparatus main unit M by way of a third pair of rollers 53. Details of the paper ejection unit 50 are described later.

The conveyance path L that conveys the paper T includes: a first conveyance path L1; a second conveyance path L2; and a third conveyance path L3. The first conveyance path L1 extends from the cassette feeding unit 51 to the transfer nip N. The second conveyance path L2 extends from the transfer nip N to the fuser unit 9. The third conveyance path L3 extends from the fuser unit 9 to the paper ejection unit 50.

A sensor as well as the registration roller pair 80 are disposed in the middle of the first conveyance path L1 (more specifically, between the paper feeding roller pair 63 and the transfer roller 8). The sensor is provided for detecting the paper T. The sensor is disposed immediately before the registration roller pair 80 in the conveyance direction of the paper T (on the upstream side in the conveyance direction). The registration roller pair 80 is designed for skew compensation of the paper T and timing adjustment with respect to formation of the toner image in the image forming portion GK. The registration roller pair 80 conveys the paper T by performing the aforementioned compensation and timing adjustment based on detection signal information from the sensor.

The paper ejection unit 50 is formed in an end portion of the third conveyance path L3. The paper ejection unit 50 is disposed in an upper portion of the apparatus main body M. The paper ejection unit 50 has an opening toward a right lateral face of the apparatus main body M (right side in FIG. 1). The paper ejection unit 50 ejects the paper T conveyed from the third conveyance path L3 to the outside of the apparatus main unit M by way of the third roller pair 53.

An ejected paper accumulating portion M1 is formed on the opening side of the paper ejection unit 50. The ejected paper accumulating portion M1 is formed on a top face (outer face) of the apparatus main unit M. The ejected paper accumulating portion M1 is a portion that is formed on the top face of the apparatus main unit M, being concave downward. A bottom face of the ejected paper accumulating portion M1 constitutes a part of the upper face of the device main body M. The paper T, on which a predetermined toner image is formed and which is ejected from the paper ejection unit 50, is stacked and collected in the ejected paper accumulating portion M1.

A sensor for detecting a sheet of paper is disposed at a predetermined position of each conveyance path.

Figure 2:
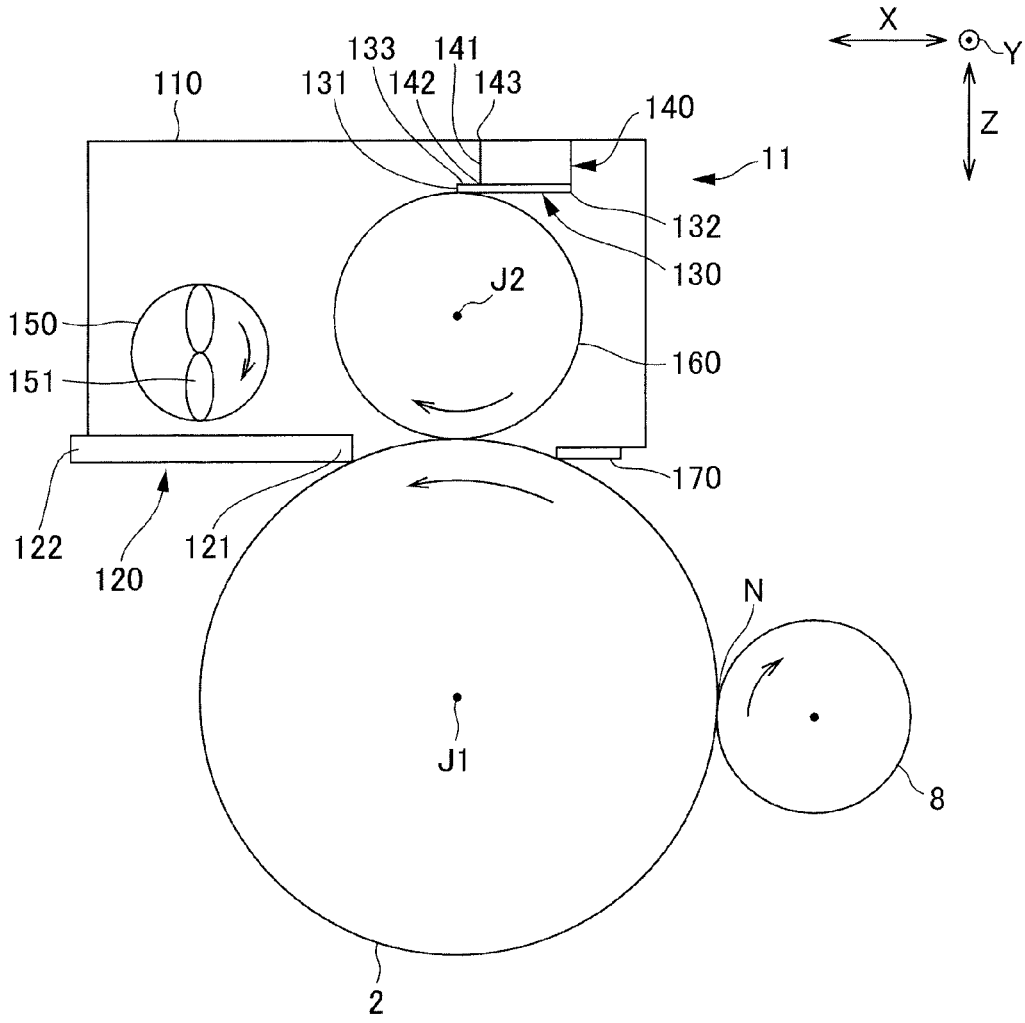
FIG. 2 is a cross-sectional view illustrating a configuration of a cleaning device 11 in the printer 1 according to the first embodiment.
Figure 3:
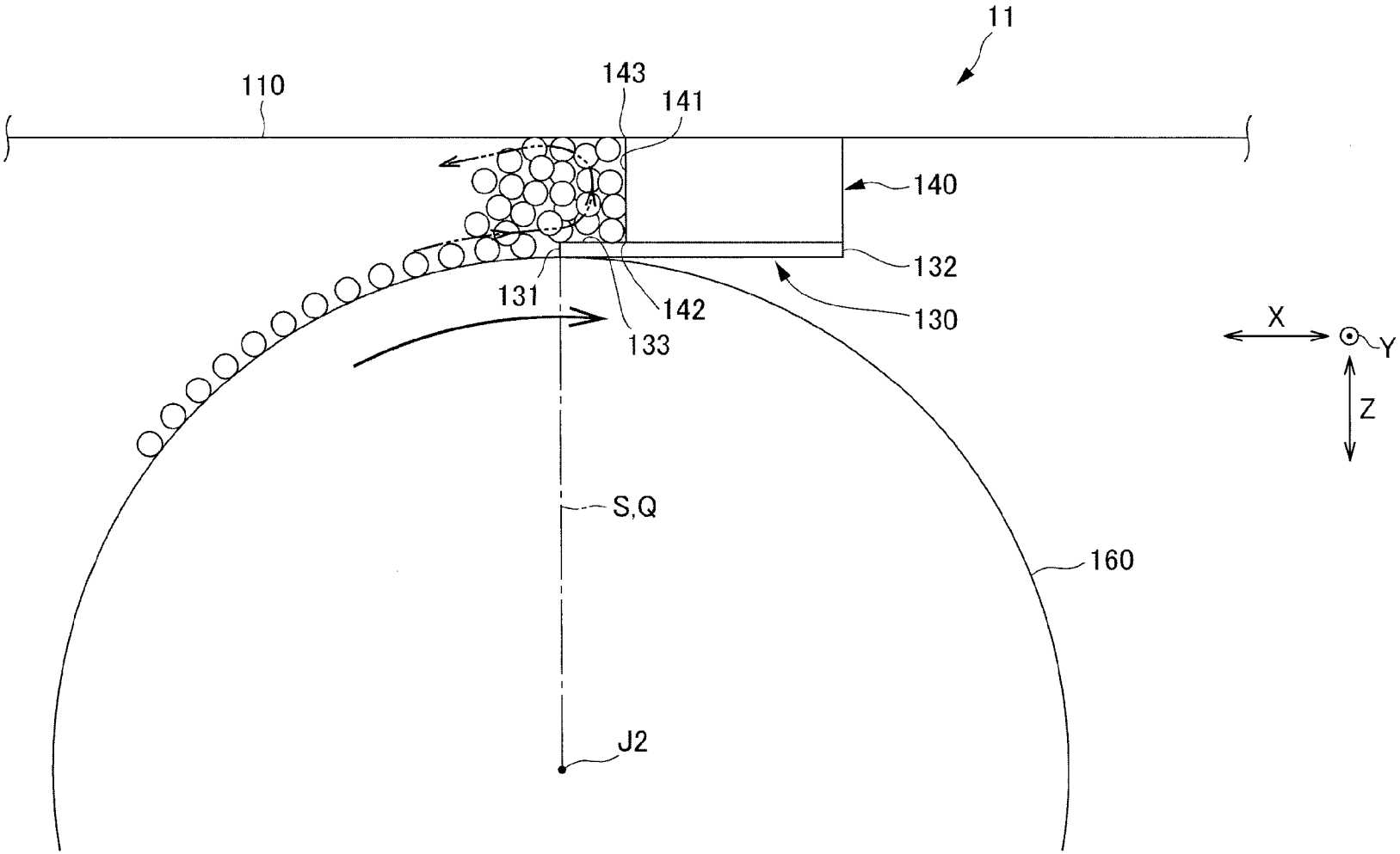
FIG. 3 is a cross-sectional view for describing a scraper 130 and a downstream side restriction portion 140 of the cleaning device 11 shown in FIG. 2.
Figure 4:
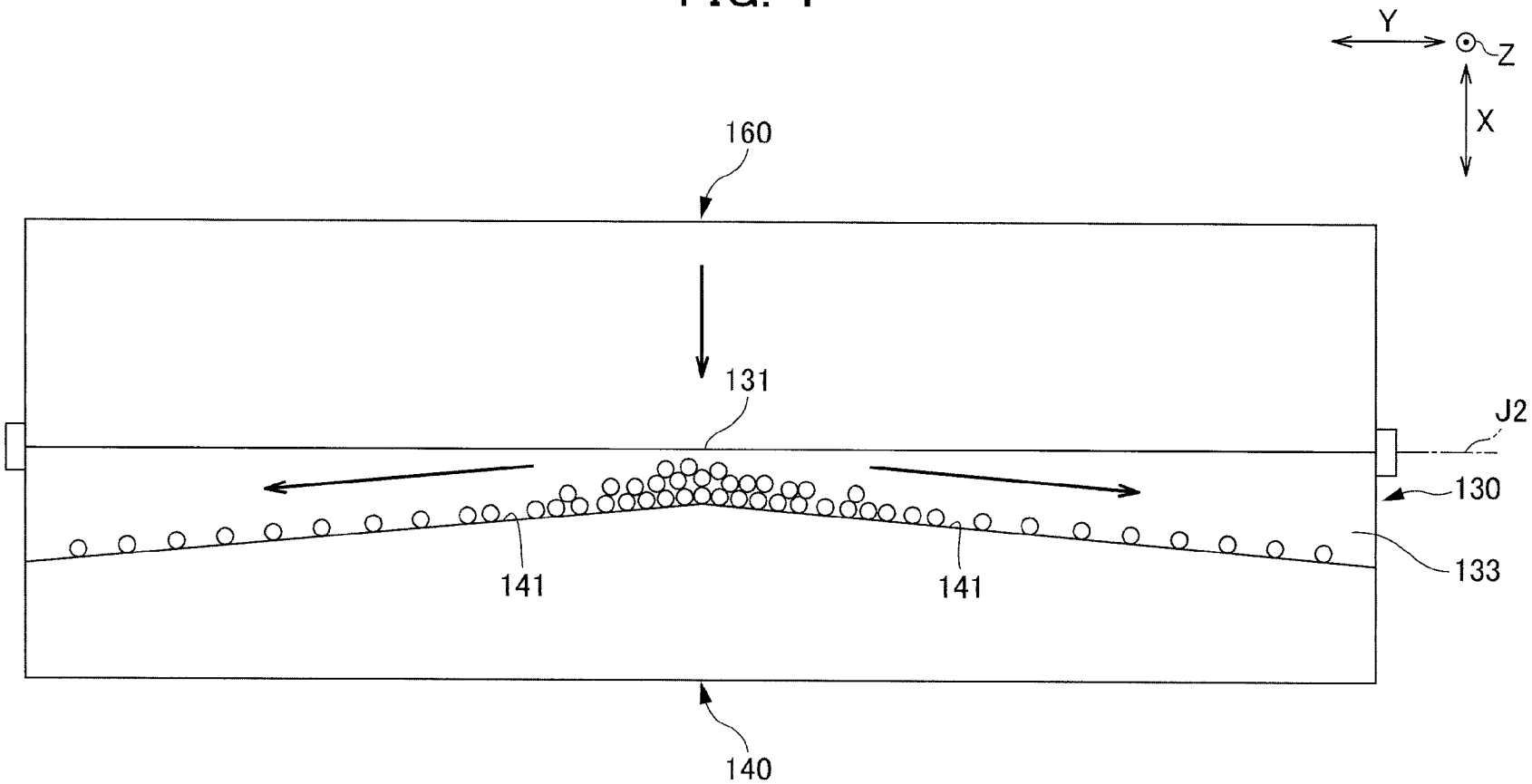
FIG. 4 is a plan view of the scraper 130 and the downstream side restriction portion 140 of the cleaning device 11 shown in FIG. 2, viewed from an upper side in a Z direction.

Next, the cleaning device 11 that provides one of features of the present disclosure will be described in detail with reference to FIGS. 2 to 4. FIG. 2 is a cross-sectional view illustrating a configuration of a cleaning device 11 in the printer 1 according to the first embodiment. FIG. 3 is a cross-sectional view for describing a scraper 130 and a downstream side restriction portion 140 of the cleaning device 11 shown in FIG. 2. FIG. 4 is a plan view of the scraper 130 and the downstream side restriction portion 140 of the cleaning device 11 shown in FIG. 2, viewed from an upper side in a Z direction.

The cleaning device 11 is described specifically with reference to FIGS. 2 and 3, which are viewed from a rear side in FIG. 1 (a rear side of the printer 1).

The cleaning device 11 cleans the surface of the photoconductor drum 2. As shown in FIG. 2, the cleaning device 11 is disposed more on a downstream side in the rotational direction of the photoconductor drum 2 than the transfer nip N, above the photoconductor drum 2 in the Z direction. The cleaning device 11 is disposed to face the surface of the photoconductor drum 2.

As shown in FIGS. 2 and 3, the cleaning device 11 includes a housing 110, a cleaning blade 120, and a sealing member 170. The housing 110 is a frame body with an opening on the photoconductor drum 2 side (a lower side in the Z direction). The cleaning device 11 includes, inside the housing 110: a cleaning roller 160 as the cleaning rotating body; a scraper 130 as the scraping member; a downstream side restriction portion 140; and a toner collection spiral 150.

The cleaning blade 120 is arranged to block the opening on the housing 110, on a first side in the X direction of a portion where the cleaning roller 160 faces the photoconductor drum 2. The sealing member 170 is arranged to block the opening on the housing 110, on a second side in the X direction of a portion where the cleaning roller 160 faces the photoconductor drum 2, to thereby prevent the toner housed in the housing 110 from falling off.

The cleaning roller 160, the scraper 130, the downstream side restriction portion 140 and the toner collection spiral 150 are formed to extend in the Y direction and have a length substantially the same as a length of the photoconductor drum 2 in the axial direction of the first rotational shaft J1. The direction of the first rotational shaft J1 is parallel to the Y direction.

The cleaning roller 160 is composed of a cylindrical member. The cleaning roller 160 is designed to remove the toner and a discharge product from the surface of the photoconductor drum 2. The cleaning roller 160 is rotatable about the second rotational shaft J2, which is parallel to the first rotational shaft J1 of the photoconductor drum 2, in a direction of the arrow shown in FIG. 2.

The rotational direction of the cleaning roller 160 is the same as the rotational direction of the photoconductor drum 2, in a portion where the photoconductor drum 2 and the cleaning roller 160 face each other. The cleaning roller 160 polishes the surface of the photoconductor drum 2 by rotating at a circumferential speed different from that of the photoconductor drum 2.

The cleaning roller 160 is arranged in sliding contact with the surface of the photoconductor drum 2 in a state of carrying a toner on the surface thereof, thereby forming a toner layer. The cleaning roller 160 is arranged in sliding contact with the surface of the photoconductor drum 2, more on a downstream side in the rotational direction of the photoconductor drum 2 than the transfer nip N between the photoconductor drum 2 and the transfer roller 8. The cleaning roller 160 thus polishes the surface of the photoconductor drum 2. In addition, an abrasive agent such as titanium oxide is added to the toner in the present embodiment.

The cleaning blade 120 is designed for scraping off the toner remaining on the surface of the photoconductor drum 2 even after cleaning by the cleaning roller 160. A front end portion 121 of the cleaning blade 120 is arranged in contact with or in proximity to the surface of the photoconductor drum 2, more on a downstream side in the rotational direction of the photoconductor drum 2 than the portion where the photoconductor drum 2 and the cleaning roller 160 face each other.

The cleaning blade 120 is composed of a rectangular plate-like material. The cleaning blade 120 is formed to extend from the front end portion 121 toward the other side in the X direction. The cleaning blade 120 is formed to extend in the Y direction (a direction of the second rotational shaft J2).

The cleaning blade 120 is arranged in contact with the photoconductor drum 2 in a counter direction. The "counter direction" of the cleaning blade 120 is a direction from the rear end portion 122 toward the front end portion 121 of the cleaning blade 120, facing the rotational direction of the photoconductor drum 2.

The rear end portion 122 of the cleaning blade 120 is fixed to the housing 110 by means of a fixing plate (not illustrated).

The scraper 130 is designed for scraping off the toner adhering to the surface of the cleaning roller 160. As shown in FIGS. 2 and 3, the scraper 130 is composed of a cuboidal plate-like material. The scraper 130 is formed to extend in a horizontal direction (X direction) from a front end portion 131 to a rear end portion 132 (an end on an opposite side to the front end portion 131). The scraper 130 is formed to extend in the Y direction.

As shown in FIG. 2, the front end portion 131 of the scraper 130 is arranged in contact with or in proximity to the surface of the cleaning roller 160, more on a downstream side in the rotational direction of the cleaning roller 160 than the portion where the photoconductor drum 2 and the cleaning roller 160 face each other.

A position of the front end portion 131 of the scraper 130 is not particularly limited. However, it is preferable that the front end portion 131 of the scraper 130 is arranged in contact with or in proximity to the surface of the cleaning roller 160, at a position in a predetermined range with reference to a vertical face S connecting a top portion of the cleaning roller 160 and the second rotational shaft J2. In this case, the "position in a predetermined range" is a position in a range of 20° on an upstream side to 20° on a downstream side from the top portion of the cleaning roller 160 in the rotational direction of the cleaning roller 160. In addition, an angle of the front end portion 131 of the scraper 130 with reference to the vertical face S can be appropriately set according to a particle size and a shape of the toner, considering a likelihood of rolling down of the toner from the surface of the cleaning roller 160 due to flowability of the toner.

In the present embodiment, the front end portion 131 of the scraper 130 is positioned at the top portion (at an angle of 0° with reference to the vertical face S) of the cleaning roller 160 in the direction Z, as shown in FIG. 3.

The scraper 130 is arranged in the counter direction with respect to the cleaning roller 160. The "counter direction" of the scraper 130 is a direction from the rear end portion 132 toward the front end portion 131 of the scraper 130, facing the rotational direction of the cleaning roller 160.

In other words, the rear end portion 132 of the scraper 130 is positioned more on a downstream side in the rotational direction of the cleaning roller 160 than a face Q connecting the second rotational shaft J2 and the front end portion 131 of the cleaning roller 160. The scraper 130 is formed to extend from the front end portion 131 to the rear end portion 132. In the first embodiment, the face Q connecting the second rotational shaft J2 and the front end portion 131 of the cleaning roller 160 corresponds to the vertical face S.

The scraper 130 has a toner receiving face 133. The toner receiving face 133 is a face of the scraper 130 opposite to the cleaning roller 160. The toner receiving face 133 is formed between the front end portion 131 and the rear end portion 132 of the scraper 130. The toner scraped off from the surface of the cleaning roller 160 by the scraper 130 is moved from the front end portion 131 of the scraper 130 to the toner receiving face 133.

The rear end portion 132 of the scraper 130 is fixed to the housing 110 by means of a fixing member (not illustrated).

The downstream side restriction portion 140 dams up the toner being moved from the front end portion 131 of the scraper 130 to the toner receiving face 133. The downstream side restriction portion 140 includes the toner restriction face 141, as shown in FIG. 3.

The first end portion 142 of the toner restriction face 141 is positioned on the toner receiving face 133. The toner restriction face 141 is formed to extend upward in the Z direction from the first end portion 142. The toner restriction face 141 is arranged to be orthogonal to the toner receiving face 133 when viewed from the Y direction (direction of the second rotational shaft J2).

A distance between the front end portion 131 of the scraper 130 and the first end portion 142 of the toner restriction face 141 of the downstream side restriction portion 140 is preferably no greater than 5 mm.

The downstream side restriction portion 140 thus configured dams the toner, which is being moved from the front end portion 131 of the scraper 130 to the toner receiving face 133, by way of the toner restriction face 141. As a result, the downstream side restriction portion 140 restricts the toner, which is being moved from the front end portion 131 of the scraper 130 to the toner receiving face 133, from moving to the downstream side in the rotational direction of the cleaning roller 160.

The second end portion 143 of the toner restriction face 141 that is on an opposite side to the toner receiving face 133 is fixed to an inner face of the housing 110. As a result, the inner face of the housing 110 restricts the toner, which is dammed by the toner restriction face 141, from moving to the downstream side in the rotational direction of the cleaning roller 160.

As shown in FIG. 4, the toner restriction face 141 of the downstream side restriction portion 140 is to slope down from a central portion to an end portion in the Y direction (direction of the second rotational shaft J2), toward a downstream side in the rotational direction of the cleaning roller 160.

The toner collection spiral 150 is arranged on a side of the cleaning roller 160, in a lower part of the inside of the housing 110. The toner collection spiral 150 is provided with a rotational shaft (not illustrated), and a blade portion 151 that is formed to intersect with the rotational shaft. According to a rotation about the rotational shaft (not illustrated), the toner collection spiral 150 feeds the waste toner in a direction of the rotational shaft (not illustrated) extending, toward a waste toner container (not illustrated).

Next, operation of the printer 1 according to the first embodiment is briefly described with reference to FIG. 1.

The paper T stored in the paper cassette 52 is fed to the first conveyance path L1 by way of the forward feed roller 61 and the feed roller pair 63, and is subsequently conveyed through the first conveyance path L1 to the registration roller pair 80.

The resist roller pair 80 performs skew compensation of the paper T and timing adjustment with respect to the toner image.

The paper T ejected from the registration roller pair 80 is introduced between the photoconductor drum 2 and the transfer roller 8 (i.e. in the transfer nip N) through the first conveyance path L1. In addition, a toner image is transferred onto the paper T between the photoconductor drum 2 and the transfer roller 8.

Subsequently, the paper T is ejected from between the photoconductor drum 2 and the transfer roller 8, and is introduced to a fusing nip between the heating rotor 9*a* and the pressing rotator 9*b* in the fuser unit 9 through the second conveyance path L2. Toner is then fused in the fixing nip and fixed onto the paper T.

Next, the sheet of paper T is fed through the third paper conveyance path L3 to the paper ejection unit 50. The paper T is discharged from the paper ejection unit 50 to the ejected paper accumulating portion M1, by means of a third roller pair 53.

Printing on the paper T housed in the paper feeding cassette 52 is thus completed.

Next, the operation of the cleaning device 11 will be described with reference to FIGS. 2 and 3.

After transfer by the transfer roller 8, a residual toner remains on the surface of the photoconductor drum 2. In this state, as the photoconductor drum 2 rotates about the first rotational shaft J1, the toner adhering to the surface of the photoconductor drum 2 is conveyed to a portion where the photoconductor drum 2 and the cleaning roller 160 face each other.

The cleaning roller 160 frictions the surface of the photoconductor drum 2 to remove the toner adhering to the surface of the photoconductor drum 2. The toner removed from the surface of the photoconductor drum 2 adheres to the surface of the cleaning roller 160. As the cleaning roller 160 rotates, the toner adhering to the surface of the cleaning roller 160 is conveyed toward the downstream side in the rotational direction of the cleaning roller 160.

The toner remaining on the surface of the photoconductor drum 2 after cleaning by the cleaning roller 160 is conveyed toward the cleaning blade 120 on the downstream side in the rotational direction of the photoconductor drum 2, in a state of adhering to the surface of the photoconductor drum 2. The cleaning blade 120 scrapes off the toner adhering to the surface of the photoconductor drum 2.

As the cleaning roller 160 rotates, the toner adhering to the surface of the cleaning roller 160 is conveyed toward the scraper 130.

Here, on the surface of the cleaning roller 160, it is necessary to maintain the amount of a toner on the surface of the cleaning roller 160 uniform in a direction of the second rotational shaft J2, in order to reduce uneven polishing of the surface of the photoconductor drum 2 by the cleaning roller 160. If the amount of the toner on the surface of the cleaning roller 160 is too high, the toner would be electrically charged due to friction with the photoconductor drum 2, leading to damage of the surface of the photoconductor drum 2. The damage of the surface of the photoconductor drum 2 may cause drum black spots (pinholes) on a resulting image; and so-called toner fall-off, where the toner falls onto a development region. On the other hand, if the amount of the toner on the surface of the cleaning roller 160 is too low, an abrasive force for polishing the surface of the photoconductor drum 2 may be insufficient.

The toner thus conveyed to the scraper 130 by the rotation of the cleaning roller 160 is scraped off by the scraper 130. The toner thus scraped off by the scraper 130 is then moved from the front end portion 131 of the scraper 130 to the toner receiving face 133. As a result, the toner thus scraped off from the surface of the cleaning roller 160 by the scraper 130 is accumulated on the toner receiving face 133 of the scraper 130.

The toner moved to and accumulated on the toner receiving face 133 is dammed by the toner restriction face 141 of the downstream side restriction portion 140. As a result, the toner, which is being moved from the front end portion 131 of the scraper 130 to the toner receiving face 133, is restricted from moving to the downstream side in the rotational direction of the cleaning roller 160.

In addition, the second end portion 143 of the toner restriction face 141 is fixed to an inner face of the housing 110. As a result, an upper portion of the inner face of the housing 110 restricts the toner, which is dammed by the toner restriction face 141, from moving to the downstream side in the rotational direction of the cleaning roller 160.

Here, on an upper side of the toner receiving face 133, the toner thus dammed by the toner restriction face 141 is moved toward the housing 110, as shown in FIG. 3, in an opposite direction to the rotational direction of the cleaning roller 160. In other words, on an upper side of the toner receiving face 133, on the scraper 130 side, the toner thus dammed by the toner restriction face 141 is moved in a rotational direction of the cleaning roller 160. The toner thus moved in the rotational direction of the cleaning roller 160 is dammed by the toner restriction face 141 and then moved to the opposite direction to the rotational direction of the cleaning roller 160 on the housing 110 side, causing convection (see FIG. 3). This allows the toner dammed by the toner restriction face 141 to move such that the amount of the toner is uniform in the Y direction (direction of the second rotational shaft J2). The toner thus dammed by the toner restriction face 141 and moved to be uniform in the Y direction is fed (adheres) to the surface of the cleaning roller 160.

The toner thus dammed by the toner restriction face 141 and moved to be uniform in the Y direction can thus be fed to the surface of the cleaning roller 160. As a result, the amount of the toner on the surface of the cleaning roller 160 is made uniform in the Y direction (direction of the second rotational shaft J2).

Furthermore, as shown in FIG. 4, the toner restriction face 141 of the downstream side restriction portion 140 according to the present embodiment is to slope down from the central portion to the end portion in the Y direction (direction of the second rotational shaft J2), toward the downstream side in the rotational direction of the cleaning roller 160. For example, in a case in which the printing ratio is high in the vicinity of a center in the Y direction, on the cleaning roller 160, the greater amount of toner tends to be accumulated in the vicinity of a center in the Y direction, as shown in FIG. 4. In such a case, by providing declivity from the center to the end portions in the Y direction, the toner restricted by the toner restriction face 141 of the downstream side restriction portion 140 is moved from the center toward the end portions in the Y direction as the cleaning roller 160 rotates, making the amount of toner uniform. As a result, the amount of the toner on the surface of the cleaning roller 160 can be made uniform in the Y direction (direction of the second rotational shaft J2) more easily.

The cleaning device 11 of the first embodiment provides, for example, the following effects.

The present embodiment is provided with the following configurations. The cleaning roller 160 is rotatable about the second rotational shaft J2 that is parallel to the first rotational shaft J1. The cleaning roller 160 is arranged in sliding contact with the surface of the photoconductor drum 2 in a state of carrying a toner on the surface thereof, thereby forming a toner layer. The scraper 130 is formed to extend in the direction of the second rotational shaft J2 and the front end portion 131 thereof is positioned in contact with or in proximity to the surface of the cleaning roller 160. The scraper 130 is formed in a plate-like shape for scraping off the toner adhering to the surface of the cleaning roller 160. The rear end portion 132, which is an opposite end to the front end portion 131, of the scraper 130 extends to be positioned more on a downstream side in the rotational direction of the cleaning roller 160 than the face Q connecting the second rotational shaft J2 and the front end portion 131 of the cleaning roller 160. The scraper 130 is provided with the toner receiving face 133 to which the toner scraped off by the scraper 130 is moved from the front end portion 131. In addition, the downstream side restriction portion 140 has the toner restriction face 141 that is arranged to be orthogonal to the toner receiving face 133 when viewed from the direction of the second rotational shaft J2. The downstream side restriction portion 140 restricts the toner, which is being moved from the front end portion 131 to the toner receiving face 133, from moving to the downstream side in the rotational direction of the cleaning roller 160.

The toner dammed by the toner restriction face 141 and moved to be uniform in the Y direction can thus be fed to the surface of the cleaning roller 160. As a result, the amount of the toner on the surface of the cleaning roller 160 is made uniform in the Y direction (direction of the second rotational shaft J2). Uneven polishing of the surface of the photoconductor drum 2 by the cleaning roller 160 can thus be reduced.

Especially in a case in which the printing ratio is low and the amount of the toner adhering to the surface of the cleaning roller 160 is small, the toner restriction face 141 can dam and convect the toner, which is being moved from the front end portion 131 of the scraper 130 to the toner receiving face 133. As a result, even in a case in which there are portions with toner adhered and portions without the toner due to the printing ratio and the printing pattern, the toner on the surface of the cleaning roller 160 can be flattened to be even in the Y direction (direction of the second rotational shaft J2). Uneven polishing by the cleaning roller 160 can be reduced by thus minimizing the influence of the printing ratio and the printing pattern.

In addition, in the present embodiment, the front end portion 131 of the scraper 130 is arranged in contact with or in proximity to the surface of the cleaning roller 160, at a top portion of the cleaning roller 160 in the vertical direction (Z direction).

As a result, the front end portion 131 of the scraper 130 is positioned at an angle of 0° with reference to the vertical face S. The toner which is dammed by the toner restriction face 141 and convected on an upper side of the toner receiving face 133 sinks under its own weight and easily adheres to the surface of the cleaning roller 160. This facilitates retention of the toner and formation of a toner layer on the surface of the cleaning roller 160. The abrasive force of the cleaning roller 160 can thus be improved.

In the present embodiment, a distance between the front end portion 131 of the scraper 130 and the toner restriction face 141 of the downstream side restriction portion 140 is no greater than 5 mm. As a result, even if the amount of toner scraped off from the cleaning roller 160 is small, the toner can be accumulated between the front end portion 131 of the scraper 130 and the toner restriction face 141. This facilitates retention of the toner and formation of a toner layer on the surface of the cleaning roller 160. The abrasive force of the cleaning roller 160 can thus be improved.

In addition, in the present embodiment, the cleaning device 11 further includes the housing 110 that houses the cleaning roller 160. In the downstream side restriction portion 140, the second end portion 143 of the toner restriction face 141 that is on an opposite side to the toner receiving face 133 is fixed to the inner face of the housing 110. As a result, the inner face of the housing 110 restricts the toner, which is dammed by the toner restriction face 141, from moving to the downstream side in the rotational direction of the cleaning roller 160. This can suppress moving of the toner toward the photoconductor drum 2 that may lead to an image forming defect.

Furthermore, in the present embodiment, the toner restriction face 141 of the downstream side restriction portion 140 is to slope down from a central portion to end portions in the Y direction (direction of the second rotational shaft J2), toward a downstream side in the rotational direction of the cleaning roller 160. As a result, the amount of the toner on the surface of the cleaning roller 160 can be made uniform in the Y direction (direction of the second rotational shaft J2) more easily.

Second Embodiment

Figure 5:
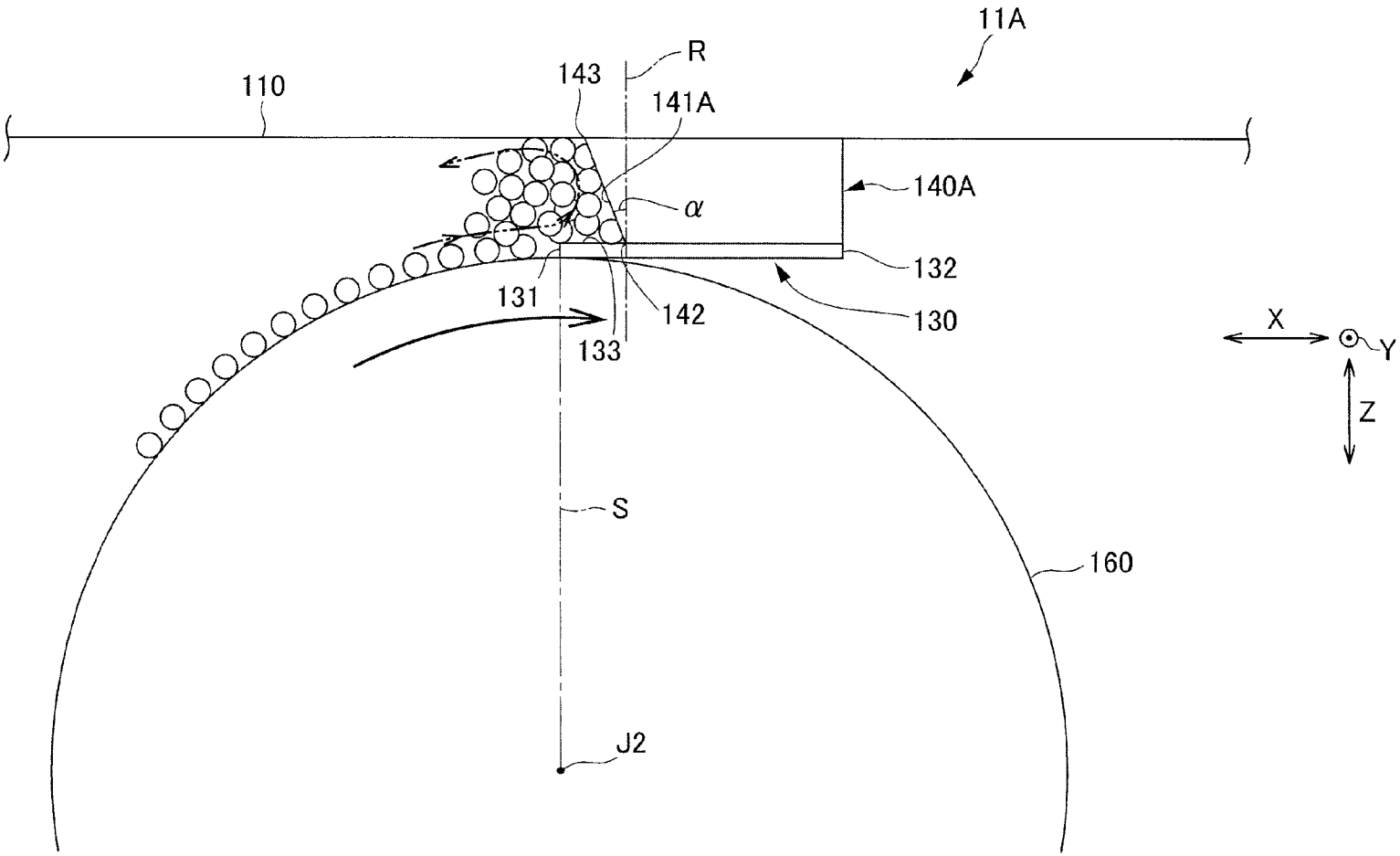
FIG. 5 is a cross-sectional view for describing a scraper 130 and a downstream side restriction portion 140A of the cleaning device 11A according to the second embodiment.

Next, the cleaning device 11A according to the second embodiment is described with reference to the drawings. In describing the second embodiment, similar constituent features to the first embodiment are referred to by the same numerals, and descriptions thereof are simplified or omitted. FIG. 5 is a cross-sectional view for describing the scraper 130 and the downstream side restriction portion 140A of the cleaning device 11A according to the second embodiment.

As shown in FIG. 5, the cleaning device 11A of the second embodiment is different from the first embodiment mainly in that the toner restriction face 141A of the downstream side restriction portion 140A is inclined obliquely downward.

As shown in FIG. 5, the toner restriction face 141A of the downstream side restriction portion 140A in the second embodiment is a face inclined at an angle α with reference to the orthogonal face R that is orthogonal to the toner receiving face 133 when viewed from the Y direction (direction of the second rotational shaft J2). The angle α between the toner restriction face 141A and the orthogonal face R is preferably in a range of −45° to +45° with reference to the orthogonal face R. In this range of angle, the toner restriction face 141A can easily dam the toner being moved on the toner receiving face 133.

More specifically, the angle in a range of −45° to +45° with reference to the orthogonal face R indicates an angle in a range of −45° to 0°, or 0° to 45° with reference to the orthogonal face R. In the present embodiment, the angle in a range of −45° to 0° with reference to the orthogonal face R is such an angle that the first end portion 142, which is an end portion of the toner restriction face 141A on a side to the toner receiving face 133, is positioned closer to the rear end portion 132 of the scraper 130 than the second end portion 143, which is an end portion opposite to the toner receiving face 133, is. On the other hand, the angle in a range of 0° to 45° with reference to the orthogonal face R is such an angle that the first end portion 142 of the toner restriction face 141A is positioned closer to the front end portion 131 of the scraper 130 than the second end portion 143 is.

In the present embodiment, the toner restriction face 141A of the downstream side restriction portion 140A is inclined as shown in FIG. 5. The first end portion 142 of the toner restriction face 141A is positioned further to the rear end portion 132 side of the scraper 130 than the second end portion 143 is. For example, as shown in FIG. 5, the toner restriction face 141A of the present embodiment, is arranged to be inclined at the angle α, which is approximately −20°, with reference to the orthogonal face R that is orthogonal to the toner receiving face 133 when viewed from the Y direction (direction of the second rotational shaft J2).

The cleaning device 11A of the second embodiment provides the following effects, in addition to the effect provided by the cleaning device 11 of the first embodiment.

In the present embodiment, the toner restriction face 141A is arranged to be inclined at the angle α with reference to the orthogonal face R that is orthogonal to the toner receiving face 133 when viewed from the Y direction (direction of the second rotational shaft J2). At this angle, the toner restriction face 141A can easily dam the toner being moved on the toner receiving face 133. This facilitates the convection of the toner. As a result, the amount of the toner on the surface of the cleaning roller 160 can be made uniform in the Y direction (direction of the second rotational shaft J2) more easily.

In addition, in the present embodiment, the toner restriction face 141A of the downstream side restriction portion 140A is inclined. The first end portion 142, which is an end portion of the toner restriction face 141A on a side to the toner receiving face 133, is positioned closer to the rear end portion 132 of the scraper 130 than the second end portion 143, which is an end portion opposite to the toner receiving face 133, is.

Consequently, on an upper side of the toner receiving face 133, the toner thus dammed by the toner restriction face 141A can be smoothly convected toward the upstream side in the rotational direction of the cleaning roller 160. This facilitates the convection of the toner in an upper side of the toner receiving face 133. As a result, the amount of the toner on the surface of the cleaning roller 160 can be made uniform in the Y direction (direction of the second rotational shaft J2) more easily.

Third Embodiment

Figure 6:
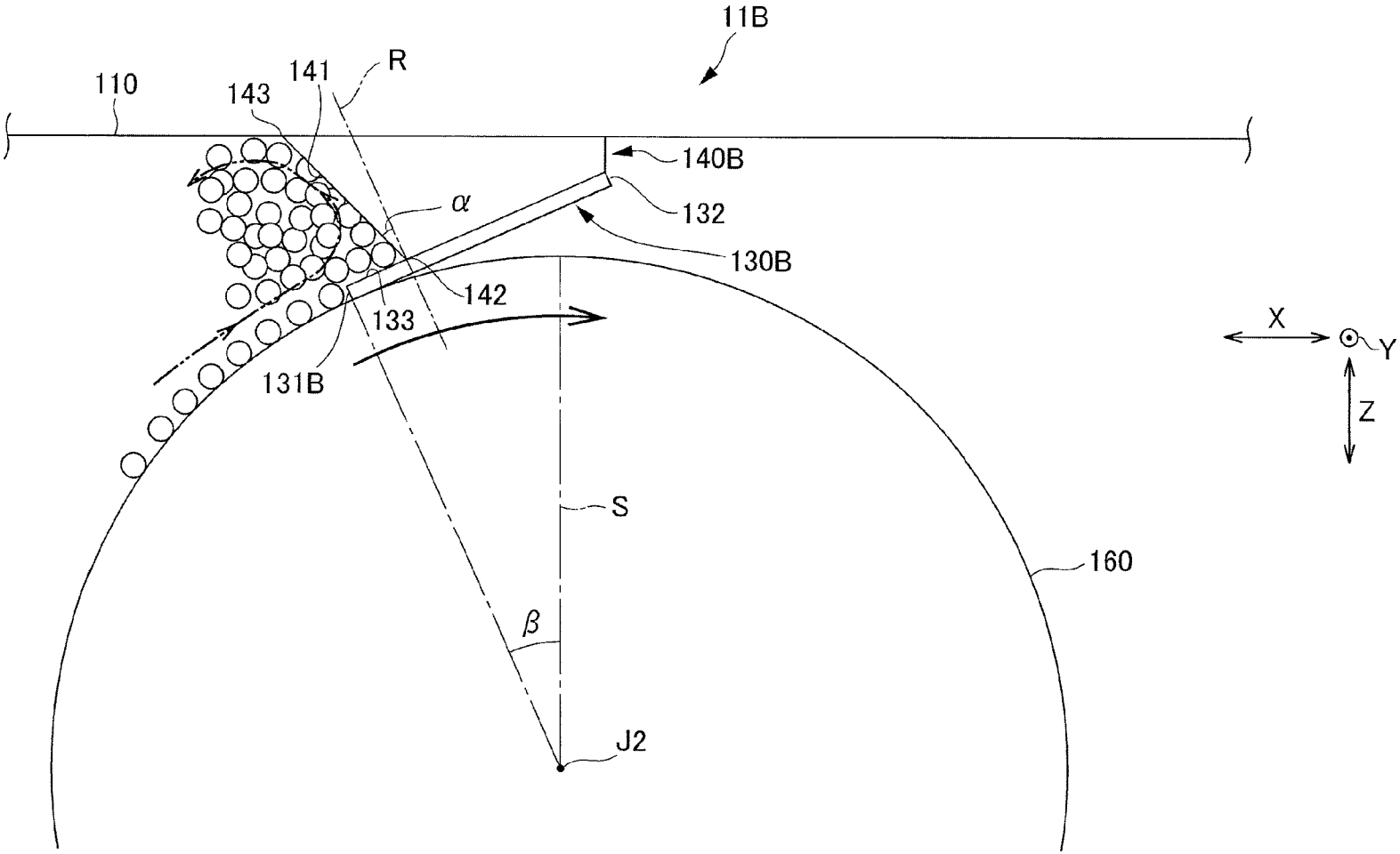
FIG. 6 is a cross-sectional view for describing a scraper 130B and a downstream side restriction portion 140B of the cleaning device 11B according to the third embodiment.

Next, the cleaning device 11B according to the third embodiment is described with reference to the drawings. In describing the third embodiment, similar constituent features to the first embodiment and the second embodiment are referred to by the same numerals, and descriptions thereof are simplified or omitted. FIG. 6 is a cross-sectional view for describing a scraper 130B and a downstream side restriction portion 140B of the cleaning device 11B according to the third embodiment.

As shown in FIG. 6, the cleaning device 11B of the third embodiment is different from the second embodiment mainly in a position of the scraper 130B.

The cleaning device 11B of the third embodiment has, in addition to the configuration of the scraper 130 of the cleaning device 11A of the second embodiment, a configuration in which the front end portion 131B of the scraper 130B is arranged in contact with or in proximity to the surface of the cleaning roller 160 at a predetermined position. Here, the predetermined position is, with reference to the vertical face S connecting the top portion of the cleaning roller 160 and the second rotational shaft J2, a position at an angle β (20° in FIG. 6) to the upstream side in the rotational direction of the cleaning roller 160 from the top position of the cleaning roller 160.

The cleaning device 11B of the third embodiment provides the following effects, in addition to the effect provided by the cleaning device 11 of the first embodiment and the second embodiment.

In the present embodiment, the front end portion 131 of the scraper 130 is positioned in contact with or in proximity to the surface of the cleaning roller 160 at a position of 20° to the upstream side in the rotational direction of the cleaning roller 160 from the top portion of the cleaning roller 160, with reference to the vertical face S connecting the top portion of the cleaning roller 160 and the second rotational shaft J2.

Given this, the front end portion 131B of the scraper 130B is arranged on an upstream side from the top portion of the cleaning roller 160 in the rotational direction of the cleaning roller 160, with reference to the vertical face S. As a result, comparing to a case of being arranged on a downstream side in the rotational direction of the cleaning roller 160, the toner dammed by the toner restriction face 141 can be smoothly convected on an upper side of the toner receiving face 133. This allows the toner dammed by the toner restriction face 141 to move in the Y direction (direction of the second rotational shaft J2). As a result, the amount of the toner on the surface of the cleaning roller 160 can be made uniform in the Y direction (direction of the second rotational shaft J2) more easily.

In addition, the front end portion 131B of the scraper 130B is arranged at a position of 20° to an upstream side from the top portion of the cleaning roller 160 in the rotational direction of the cleaning roller 160, with reference to the vertical face S. The toner which is dammed by the toner restriction face 141 and convected on an upper side of the toner receiving face 133 sinks under its own weight and easily adheres to the surface of the cleaning roller 160. This facilitates retention of the toner and formation of a toner layer on the surface of the cleaning roller 160, thereby improving abrasive force of the cleaning roller 160.

Fourth Embodiment

Figure 7:
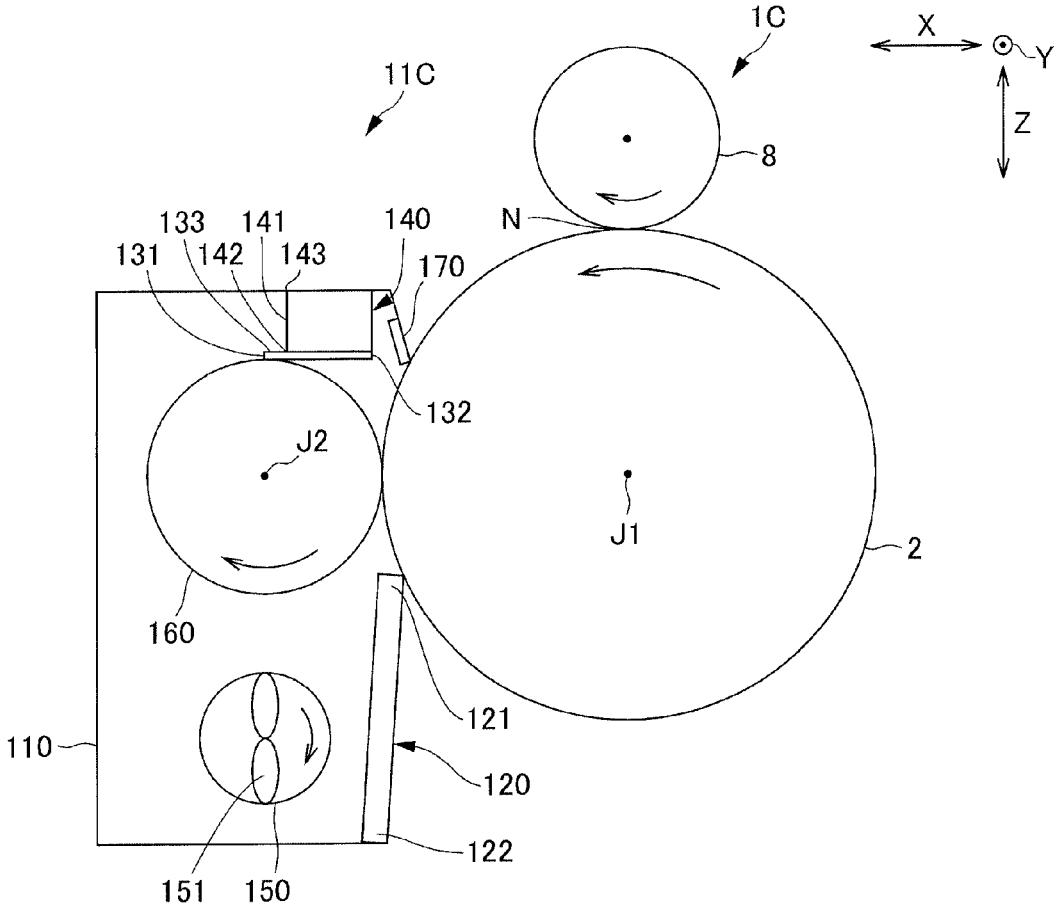
FIG. 7 is a cross-sectional view illustrating constituent elements of the cleaning device 11C in the printer 10 according to the fourth embodiment.

Next, the cleaning device 11C according to the fourth embodiment is described with reference to the drawings. In describing the fourth embodiment, similar constituent features to the first embodiment are referred to by the same numerals, and descriptions thereof are simplified or omitted. FIG. 7 is a cross-sectional view illustrating constituent elements of the cleaning device 11C in the printer 1C according to the fourth embodiment.

As shown in FIG. 7, the cleaning device 11C of the fourth embodiment is different from the first embodiment mainly in arrangement of the transfer roller 8 and the cleaning device 11C with respect to the photoconductor drum 2.

More specifically, the transfer roller 8 is arranged on an upper side of the photoconductor drum 2 in the vertical direction Z.

The cleaning device 11C is disposed on a first side of the photoconductor drum 2 in the X direction. The cleaning roller 160 of the cleaning device 11C is arranged in sliding contact with the surface of the photoconductor drum 2, adjacent to the photoconductor drum 2 on the first side thereof in the horizontal direction (X direction).

It should be noted that since the configuration of the cleaning device 11C is the same as the first embodiment except for being arranged on the first side of the photoconductor drum 2 in the X direction and the description of the first embodiment can be applied thereto, detailed description thereof is omitted.

The cleaning device 11C of the fourth embodiment provides the same effects as those of the cleaning device 11 of the first embodiment.

Although preferred embodiments have been described above, the present disclosure is not limited to the aforementioned embodiments, and can be carried out in various modes.

In the first embodiment, the toner restriction face 141 is configured to be to slope down from a central portion to end portions in the Y direction (direction of the second rotational shaft J2), toward a downstream side in the rotational direction of the cleaning roller 160; however, the present disclosure is not limited thereto. For example, the toner restriction face 141 can be formed in a planar shape in the Y direction.

In addition, in the embodiment, the toner restriction face 141 is formed in a planar shape when viewed from the Y direction; however, the present disclosure is not limited thereto. For example, the toner restriction face 141 can be formed in a curved shape when viewed from the Y direction. If the toner restriction face 141 is curved to be concave toward the downstream side restriction portion 140, the toner is moved along the curved surface on an upper side of the toner receiving face 133, thereby facilitating the convection of the toner.

Furthermore, in the first embodiment, the cleaning device 11 is disposed on a top portion of the photoconductor drum 2 in the Z direction, and, in the fourth embodiment, the cleaning device 11C is disposed on the first side of the photoconductor drum 2 in the X direction; however, the present disclosure is not limited thereto. The cleaning device 11 can also be disposed on a lowest part of the photoconductor drum 2 in the Z direction.

The black-and-white printer 1 is exemplified in the present embodiment as an image forming apparatus; however, the present disclosure is not limited thereto and can be a copy machine, a color printer, a facsimile machine, and a multifunctional peripheral having functions thereof.

The invention claimed is:

1. A cleaning device that cleans a surface of an image carrying body being rotatable about a first rotational shaft, comprising:

a cleaning rotating body that is rotatable about a second rotational shaft that is parallel to the first rotational shaft, the cleaning rotating body being arranged in sliding contact with the surface of the image carrying body in a state of carrying a toner on the surface thereof, thereby forming a toner layer;

a scraping member that is formed to extend in a direction of the second rotational shaft, the scraping member being a plate-like member with a front end portion being arranged in contact with or in proximity to a surface of the cleaning rotating body to thereby scrape off a toner adhering to the surface of the cleaning rotating body, the scraping member being formed to extend such that a rear end portion, which is opposite to the front end portion, is arranged more on a downstream side in a rotational direction of the cleaning rotating body than a face connecting the second rotational shaft of the cleaning rotating body with the front end portion, and the scraping member including a toner receiving face to which the toner that has been scraped off by the scraping member is carried from the front end portion; and a downstream side restriction portion having a toner restriction face that is arranged to be orthogonal to the toner receiving face when viewed from the second rotational shaft, the downstream side restriction portion restricting movement of the toner, which is to be carried from the front end portion to the toner receiving face, to a downstream side in a rotational direction of the cleaning rotating body, wherein a distance between the front end portion of the scraping member and the toner restriction face of the downstream side restriction portion is no greater than 5 mm.

2. The cleaning device according to claim 1, wherein the front end portion of the scraping member is arranged in contact with or in proximity to the surface of the cleaning rotating body at a position in a range of 20° on an upstream side to 20° on a downstream side from a top portion of the cleaning rotating body in a rotational direction of the cleaning rotating body, with reference to a vertical face connecting the top portion of the cleaning rotating body with the second rotational shaft.

3. The cleaning device according to claim 1 further comprising a housing that houses the cleaning rotating body, wherein a second end portion of the toner restriction face that is on an opposite side to the toner receiving face is fixed to an inner face of the housing.

4. The cleaning device according to claim 1, wherein the toner restriction face of the downstream side restriction portion is to slope down from a central portion to an end portion in the direction of the second rotational shaft toward a downstream side in a rotational direction of the cleaning rotating body.

5. An image forming apparatus comprising: at least one image carrying body on a surface of which an electrostatic latent image is formed; and the cleaning device according to claim 1.

6. A cleaning device that cleans a surface of an image carrying body being rotatable about a first rotational shaft, comprising:

a cleaning rotating body that is rotatable about a second rotational shaft that is parallel to the first rotational shaft, the cleaning rotating body being arranged in sliding contact with the surface of the image carrying body in a state of carrying a toner on the surface thereof, thereby forming a toner layer;

a scraping member that is formed to extend in a direction of the second rotational shaft, the scraping member being a plate-like member with a front end portion being arranged in contact with or in proximity to a surface of the cleaning rotating body to thereby scrape off a toner adhering to the surface of the cleaning rotating body, the scraping member being formed to extend such that a rear end portion, which is opposite to the front end portion, is arranged more on a downstream side in a rotational direction of the cleaning rotating body than a face connecting the second rotational shaft of the cleaning rotating body with the front end portion, and the scraping member including a toner receiving face to which the toner that has been scraped off by the scraping member is carried from the front end portion; and a downstream side restriction portion having a toner restriction face that is arranged to be inclined with respect to a face that is orthogonal to the toner receiving face when viewed from the second rotational shaft, the downstream side restriction portion restricting movement of the toner, which is to be carried from the front end portion to the toner receiving face, to a downstream side in a rotational direction of the cleaning rotating body, wherein a distance between the front end portion of the scraping member and the toner restriction face of the downstream side restriction portion is no greater than 5 mm.

7. The cleaning device according to claim 6, wherein an inclination angle of the toner restriction face is in a range of −45° to +45° with reference to the face that is orthogonal to the toner receiving face.

8. The cleaning device according to claim 6, wherein an angle between the toner restriction face and the toner receiving face is smaller than 90°.

9. The cleaning device according to claim 6 further comprising a housing that houses the cleaning rotating body, wherein a second end portion of the toner restriction face that is on an opposite side to the toner receiving face is fixed to an inner face of the housing.

10. The cleaning device according to claim 6, wherein the toner restriction face of the downstream side restriction portion is to slope down from a central portion to an end portion in the direction of the second rotational shaft toward a downstream side in a rotational direction of the cleaning rotating body.

11. An image forming apparatus comprising: at least one image carrying body on a surface of which an electrostatic latent image is formed; and the cleaning device according to claim 6.

12. A cleaning device that cleans a surface of an image carrying body being rotatable about a first rotational shaft, comprising:

a cleaning rotating body that is rotatable about a second rotational shaft that is parallel to the first rotational shaft, the cleaning rotating body being arranged in sliding contact with the surface of the image carrying body in a state of carrying a toner on the surface thereof, thereby forming a toner layer;

a scraping member that is formed to extend in a direction of the second rotational shaft, the scraping member being a plate-like member with a front end portion being arranged in contact with or in proximity to a surface of the cleaning rotating body to thereby scrape off a toner adhering to the surface of the cleaning rotating body, the scraping member being formed to extend such that a rear end portion, which is opposite to the front end portion, is arranged more on a downstream side in a rotational direction of the cleaning rotating body than a face connecting the second rotational shaft of the cleaning rotating body with the front end portion, and the scraping member including a toner receiving face to which the toner that has been scraped off by the scraping member is carried from the front end portion; and a downstream side restriction portion having a toner restriction face that is arranged to be inclined with respect to a face that is orthogonal to the toner receiving face when viewed from the second rotational shaft, the downstream side restriction portion restricting movement of the toner, which is to be carried from the front end portion to the toner receiving face, to a downstream side in a rotational direction of the cleaning rotating body, wherein the front end portion of the scraping member is arranged in contact with or in proximity to the surface of the cleaning rotating body at a position in a range of 20° on an upstream side to 20° on a downstream side from a top portion of the cleaning rotating body in a rotational direction of the cleaning rotating body, with reference to a vertical face connecting the top portion of the cleaning rotating body with the second rotational shaft.

* * * * *